US006976866B2

(12) United States Patent
Jaschke et al.

(10) Patent No.: US 6,976,866 B2
(45) Date of Patent: Dec. 20, 2005

(54) JUNCTION BLOCK ASSEMBLY

(75) Inventors: Bernhard Jaschke, Lage (DE); Frank Polley, Lage (DE); Stephan Fehling, Lage (DE); Walter Hanning, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/860,496

(22) Filed: Jun. 4, 2004

(65) Prior Publication Data

US 2004/0259410 A1 Dec. 23, 2004

(30) Foreign Application Priority Data

Jun. 17, 2003 (DE) ..... 203 09 334 U

(51) Int. Cl.[7] ..... H01R 4/24
(52) U.S. Cl. ..... 439/402; 439/403
(58) Field of Search ..... 439/402, 417, 439/413, 411, 412, 403, 404

(56) References Cited

U.S. PATENT DOCUMENTS 5,021,761 A * 6/1991 Stack et al. ..... 337/68
5,368,501 A 11/1994 Asbell
5,857,870 A * 1/1999 Carter ..... 439/402

FOREIGN PATENT DOCUMENTS

DE 29 06 031 A1 8/1979
DE 295 14 867 U1 1/1996
DE 199 06 465 C2 2/2001
DE 200 19 568 U1 3/2001
DE 100 45 764 A1 4/2001
DE 199 21 960 C1 5/2001
DE 200 17 134 U1 3/2002
WO WO 02/15 337 A1 2/2002

* cited by examiner

*Primary Examiner*—Ross Gushi
*Assistant Examiner*—Phuongchi Nguyen
(74) *Attorney, Agent, or Firm*—Lawrence E. Laubscher, Sr.; Lawrence E. Laubscher, Jr.

(57) ABSTRACT

A connector junction block of flat thin design is adapted for connection with one or more insulated electrical conductors, and includes base and cover members that cooperate to define a chamber, and an operating member that is mounted in the chamber for movement between first and second positions relative to at least one of the base and cover members. One end of the insulated conductor is inserted into the chamber via a first conductor opening contained in the cover member, and extends into a second conductor opening contained in the operating member. The operating member carries an insulation piercing arrangement that is operable when the operating member is displaced toward its second position to pierce the insulation and electrically engage the conductor. In one embodiment, the cover and base member are connected to define a rigid housing within which the operating member is displaced by an external operating tool. In a second embodiment, the operating member is supported in fixed relation by the base member, and the cover member, together with the conductors supported thereby, are displaced relative to the base member and the operating member, thereby to effect.

18 Claims, 5 Drawing Sheets

JUNCTION BLOCK ASSEMBLY

CROSS REFERENCE TO RELATED APPLICATIONS

This application claims benefit of the German Application No. 203 09 334.8 filed on Jun. 17, 2003.

BACKGROUND OF THE INVENTION

1. Field of the Invention

A junction block assembly of thin flat design includes base and cover members that cooperate to define a chamber, and an operating member that is mounted in the chamber for displacement relative to at least one of the cover and base members, thereby to pierce the insulation layer of a conductor the end of which is introduced into the chamber via a first conductor opening contained in the cover member. In one embodiment, the cover and base members are connected to define a rigid housing within which the operating member is displaced by means of an auxiliary tool. In a second embodiment, the operating member is supported in fixed relation by the base member, and the cover member is connected for sliding movement relative to the base and operating members, thereby to effect the insulation piercing operation.

2. Description of the Related Art

Junction block assemblies adapted for insulation-piercing electrical connection with conductors are well known in the patented prior art, as evidenced by the German Off. Nos. DE 29 06 031 and DE 100 45 764, German Patents Nos. DE 199 06 465 and 199 21 960, and published International Application No. WO 02/15337. In these prior devices, a movable element is provided that pierces the conductor insulation layer to effect electrical connection with the conductor. Many of the known conductor junction blocks are bulky in size, complicated and expensive to construct, and require many moving parts that are difficult to assemble. The present invention was developed to avoid the drawbacks of the known junction block connectors and to provide an improved connector that is relatively flat and thin for the conservation of space, inexpensive to produce, and positive in operation.

BRIEF SUMMARY OF THE INVENTION

Accordingly, a primary object of the invention is to provide a relatively thin junction block arrangement including base and cover members that cooperate to define a housing containing a chamber, and an operating member that is arranged in the housing chamber for relative movement with regard to at least the cover member between a disconnected first position, and an electrically connected second position, thereby to pierce the outer insulation layer and electrically engage a conductor the end of which is inserted into the housing chamber via a conductor opening contained in the cover member.

According to a more specific object of the invention, the cover and base members are connected together to define a rigid housing within which the operating member is slidably displaced between its first and second positions by an auxiliary operating tool that extends at one end into the chamber via a tool access opening contained in the cover member. The operating member is operable to electrically connect a first pair of conductors arranged on opposite sides of the tool access opening. Alternatively, in a modified version, the operating member connects a pair of conductors arranged on the same side of the tool access opening. According to a further modification, the operating member includes an integral soldering tab connection that extends orthogonally outwardly of the housing chamber via a tab opening contained in the cover member, thereby to affording the soldering of a bare wire to the tab portion of the movable operating member.

According to a second embodiment of the invention, the cover member is connected for sliding movement relative to the base member, and the operating member is supported in fixed relation by the base member, whereby a conductor which extends into the chamber via a conductor opening contained in the cover member is laterally transported by the cover relative to the operating member, thereby to effect the desired piercing of the insulation layer and electrical engagement with the conductor.

A further object is to provide a plurality of relatively thin flat rectangular junction block devices that may be laterally connected together to define an assembly thereof.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figures 1A, 1B, 1C, 2:
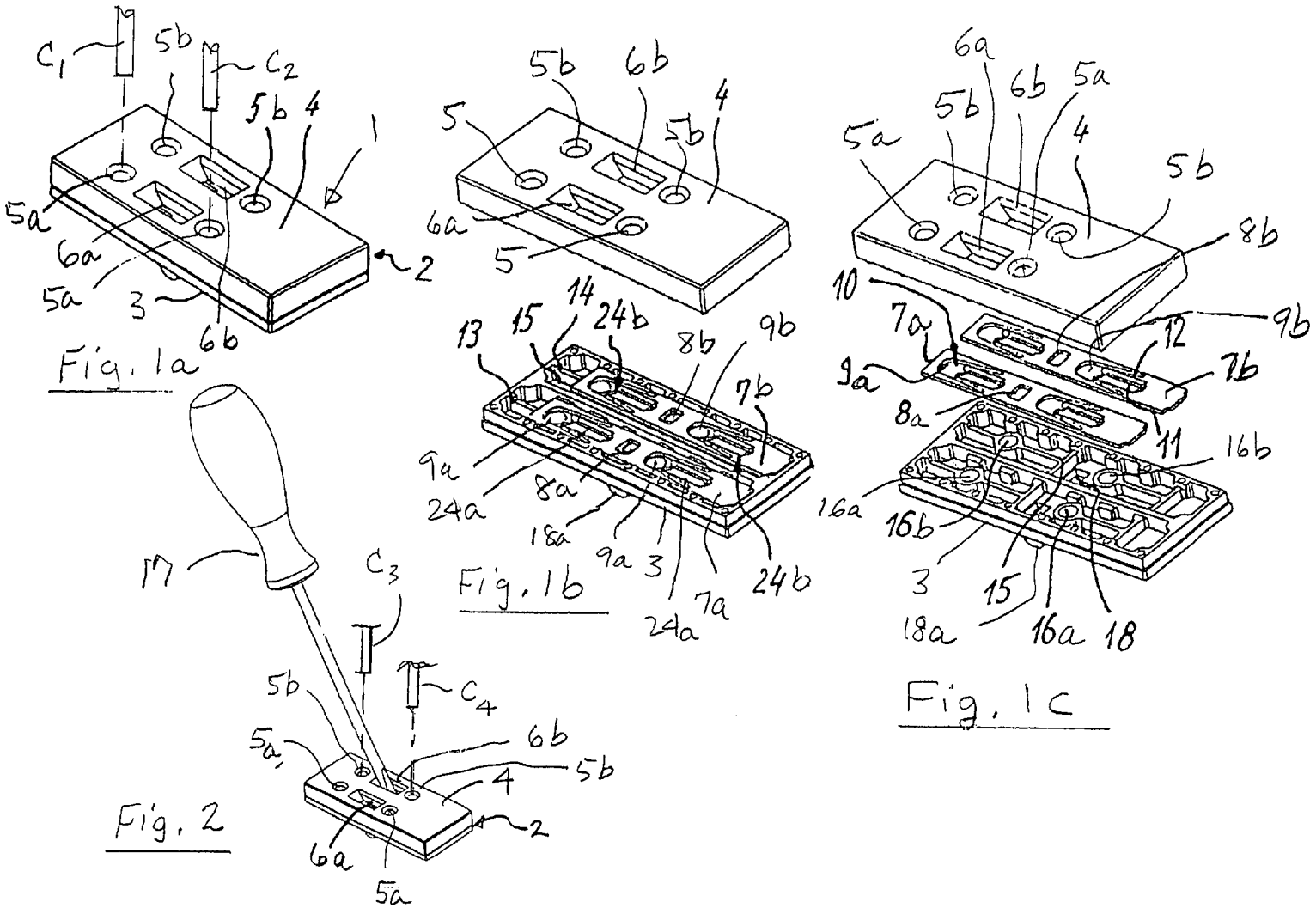
FIG. 1*a* is a front perspective view of the junction block assembly according to a first embodiment of the present invention.
FIG. 1*b* is a corresponding view of the device of FIG. 1*a* with the cover removed.
FIG. 1*c* is a corresponding exploded view of the apparatus of FIG. 1*a;*
FIG. 2 is a perspective view illustrating the manner of operation of the apparatus of FIG. 1.

Referring first more particularly to FIGS. 1*a*–1*c* and 2, the junction block assembly 1 of the present invention includes a rigid housing 2 having a base member 3, and a cover member 4 rigidly fastened to the base member. The base and cover members are formed from an electrically insulating synthetic plastic material and cooperate to define therebetween a chamber in which are slidably mounted a pair of rigid operating members or plates 7 that are formed of an electrically conducting metal, such as copper, aluminum or a suitable alloy. As shown in FIG. 1*b*, the operating members 7*a* and 7*b* are slidably mounted within recesses 13 and 14, respectively, contained in the base member 3.

The cover member 4 contains a pair of laterally spaced rectangular tool access openings 6*a* and 6*b* on opposite sides of each of which are arranged a pair of circular first conductor openings 5*a* and 5*b*, respectively. As best shown in FIGS. 1*b* and 1*c*, in accordance with the present invention, the operating members 7*a* and 7*b* contain pairs of second conductor openings 9*a* and 9*b* that are arranged beneath the first conductor openings 5*a* and 5*b*, respectively, when the operating members are in their first positions illustrated in FIG. 1*b* relative to the cover member 4. The operating members are supported for sliding movement within their respective recesses by a lattice-type bridge support system 15 including longitudinally and transversely extending bridge components that contain conductor-end-supporting recesses 16*a* and 16*b* that are arranged below the first conductor insertion openings 5*a* and 5*b*, respectively. The base member 3 also contains a plurality of recesses 18 that define bottom support feet 18*a*, respectively.

The second conductor openings 9*a* and 9*b* contained in the operating members communicate with insulation piercing means 24*a* and 24*b*, respectively, each of the insulation piercing means including a pair of opposed spaced coplanar knife edges 11 and 12. Preferably, in order to achieve the desired insulation piercing operation, knife edges 11 and 12 are slightly inclined relative to each other to produce the desired insulation piercing effect, as will be described in greater detail below. Arranged between the pairs of second conductor openings 9*a* and 9*b* on each operating member 7*a* and 7*b* are operating grooves or recesses 8*a* and 8*b*, respectively, which operating recesses are arranged for engagement by the tip of a screwdriver 17 or the like that is inserted into the housing chamber via the associated tool-receiving opening 6*a* or 6*b*, respectively.

Operation

In operation, assume that two insulated conductors $C_1$ and $C_2$ are to be electrically connected together by the junction block connector means 1 of FIG. 1*a*, and assume further that the operating members 7*a* and 7*b* are in their first positions shown in FIG. 1*b*. The ends of the insulated conductors are inserted into the housing chamber via the two first conductor openings 5*a*, through the two second conductor openings 9*a* contained in the operating member 7*a*, and into the corresponding two end-supporting recesses 16*a* contained in the base member 3. The tip of an operating screwdriver 17 is then inserted into the chamber via the rectangular tool access opening 6*a*, and extends into the operating recess 8*a* contained in the operating member 7*a*. The operating tool 17 is pivoted about the adjacent edge of the tool access opening 6*a* to displace the operating member 7*a* to the left in FIG. 2 toward the second position relative to the housing 2. During this sliding displacement of the operating member, the ends of the conductors $C_1$ and $C_2$ are supported in the recesses 16*a*, and the slightly relatively inclined knife edges of the two piercing means 24*a* progressively pierce and cut into the insulation and come into electrical engagement with the conductors, thereby to electrically connect the conductors via the operating member 7*a*. Similarly, as shown in FIG. 2, in order to electrically connect a second pair of insulated conductors $C_3$ and $C_4$, the ends thereof are inserted into the other pair of conductor insertion openings 5*b*, and the operating member 7*b* is slidably displaced to the second position by means of the pivotally operable tool 17. The conductors may be disconnected from the junction block assembly by pivoting the tool 17 in the opposite direction to return the operating members to their initial first positions, thereby to permit removal of the conductors from the housing.

Figures 3A, 3B, 3C, 4:
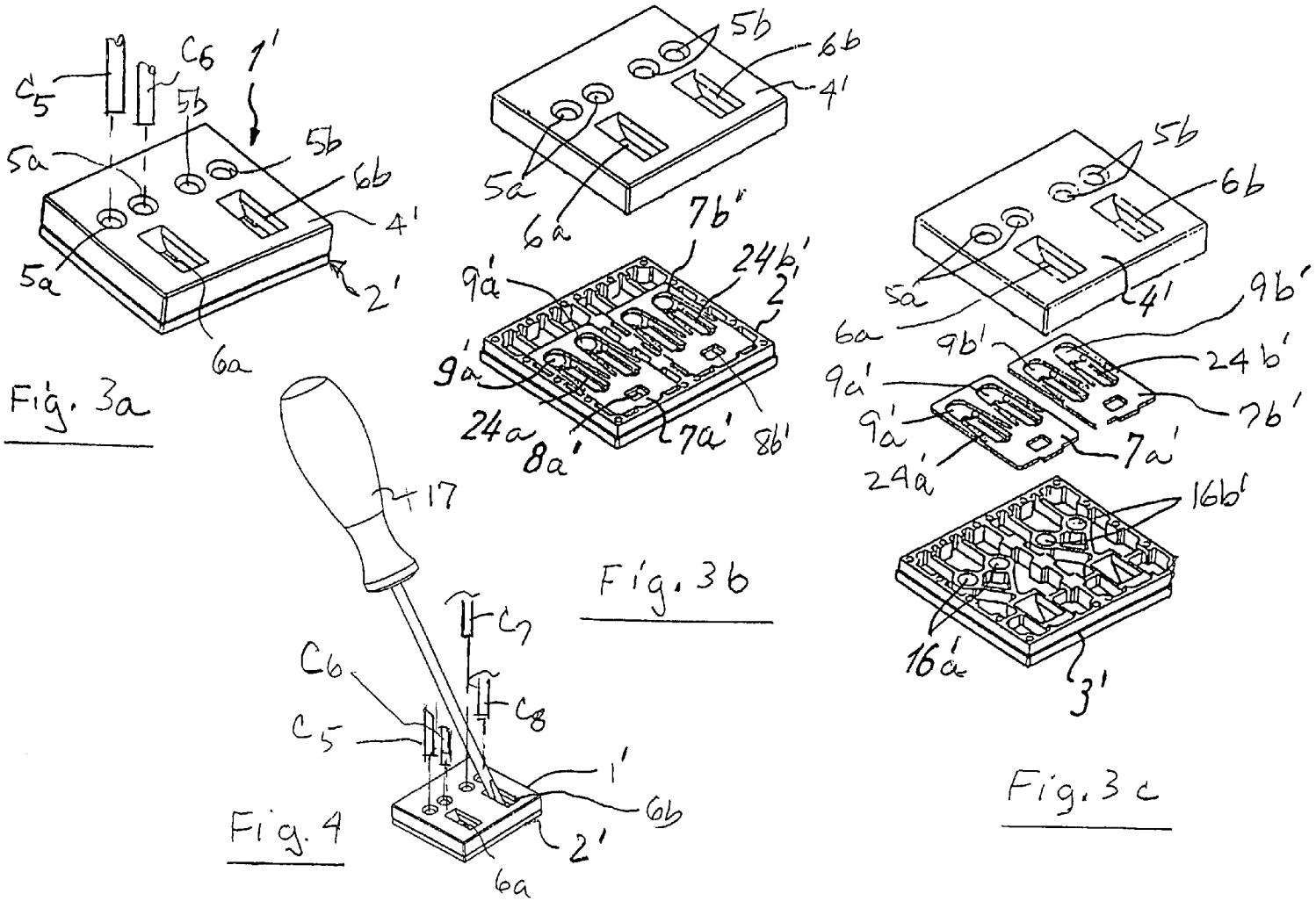
FIG. 3*a* is a front perspective view of a modification of the apparatus of FIG. 1.
FIG. 3*b* is a corresponding view with the cover removed.
FIG. 3*c* is an exploded view of the apparatus of FIG. 3*a;*
FIG. 4 is a perspective view illustrating the manner of operation of the apparatus of FIG. 3*a;*
Figure 5C:
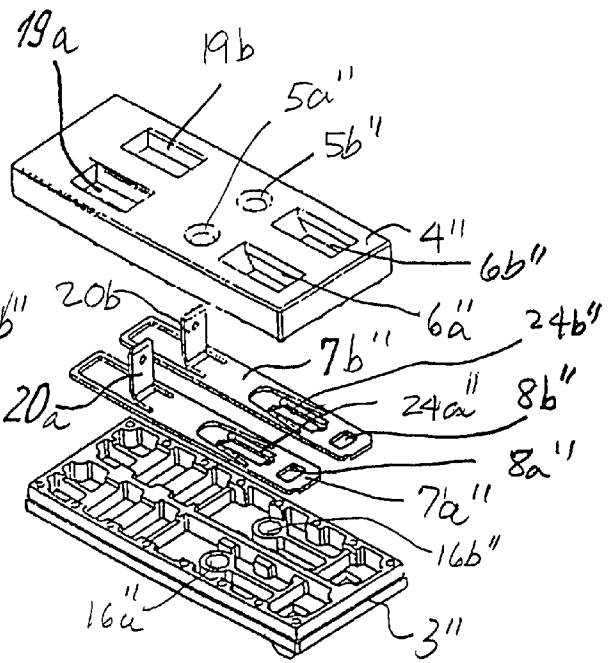
FIG. 5*c* is an exploded view of the device of FIG. 5*a;*
Figure 5B:
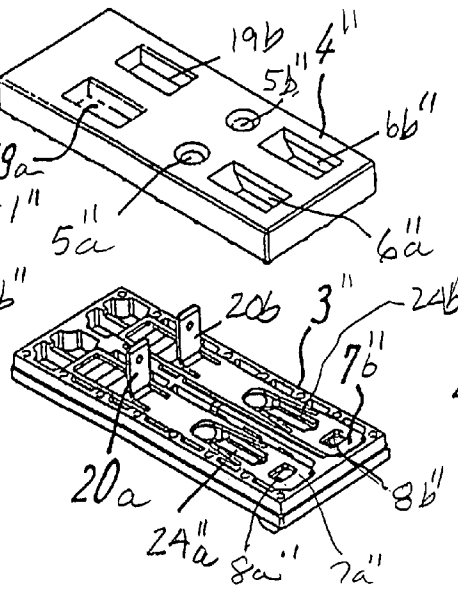
FIG. 5*b* is a corresponding view with the cover removed.
Figure 5A:
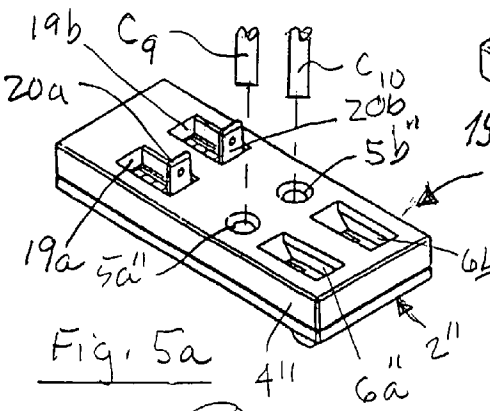
FIG. 5*a* is a front perspective view of a modification of the apparatus of FIG. 1*a* wherein the operating member is provided with a soldering tab.
Figure 6:
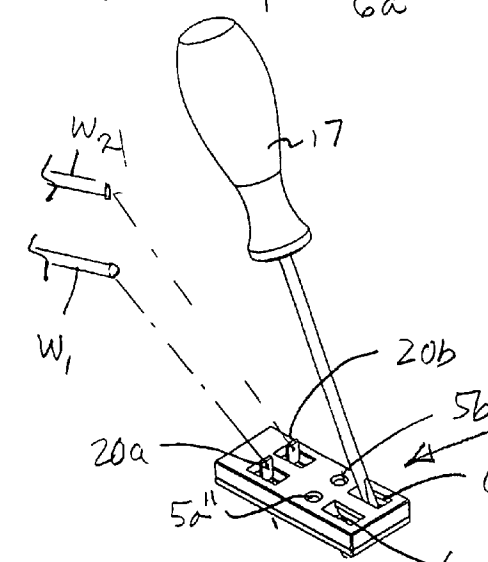
FIG. 6 is a front perspective view illustrating the manner of operation of the apparatus of FIG. 5*a;*

Referring now to the modification illustrated in FIGS. 3*a*–3*c* and 4, the pairs of conductor receiving openings 5*a* and 5*b* contained in the cover member 4' are arranged in a row on the same side as the pair of tool access openings 6*a* and 6*b*. Again, the cover and base members 4' and 3' are connected to define a rigid housing defining a chamber within which are slidably mounted the operating members 7*a'* and 7*b'*. In this modification, the second conductor receiving openings 9*a'* and 9*b'* are contained in the operating members on the same side relative to the operating recesses 8*a'* and 8*b'*, said second openings being arranged beneath the first conductor receiving openings 5*a* and 5*b*, respectively. Thus, when the operating member 7*a'* is displaced from it first position to its second position relative to the housing 1' by means of the operating tool 17 engaging the recess 8*a'*, the insulation layers of conductors $C_5$ and $C_6$ are pierced by the insulation piercing means 24*a'*, and the conductors are electrically connected by the operating member 7*a'*. Similarly, a second pair of conductors $C_7$ and $C_8$ may be connected by displacement of the operating member 7*b'* to its second position by the tool 17, as shown in FIG. 4.

Referring to the modification of FIGS. 5*a*–5*c* and 6, the cover 4" of the junction block connector 1" contains a pair of tab-receiving openings 19*a* and 19*b* that receive the soldering tabs 20*a* and 20*b* that extend orthogonally upwardly from the operating members 7*a"* and 7*b"*, respectively. In this case, the conductor $C_9$ may be connected to a bare wire $W_1$ (FIG. 6) by inserting the conductor into the chamber of rigid housing 2" via the first conductor insertion opening 4*a*, through the second conductor opening contained in the operating member 7*a"*, and into the end receiving opening 16*a"* contained in the base member 3". The operating member 7*a"* is then displaced to its second position by tool 17, thereby to cause piercing of the insulation layer by the piercing means 24*a"* to effect electrical connection between the conductor and the operating member 7*a"*, whereupon the bare wire $W_1$ is soldered to the tab 20*a*. Similarly, another conductor $C_{10}$ can be connected to another bare wire $W_2$ by the operation of the other operating member 7*b"* to its second position by the tool 17, and by soldering the bare wire $W_2$ to the tab 20*b*.

Figures 7A, 7B, 7C, 7D, 7E, 7F, 7G, 7H, 7I, 7J:
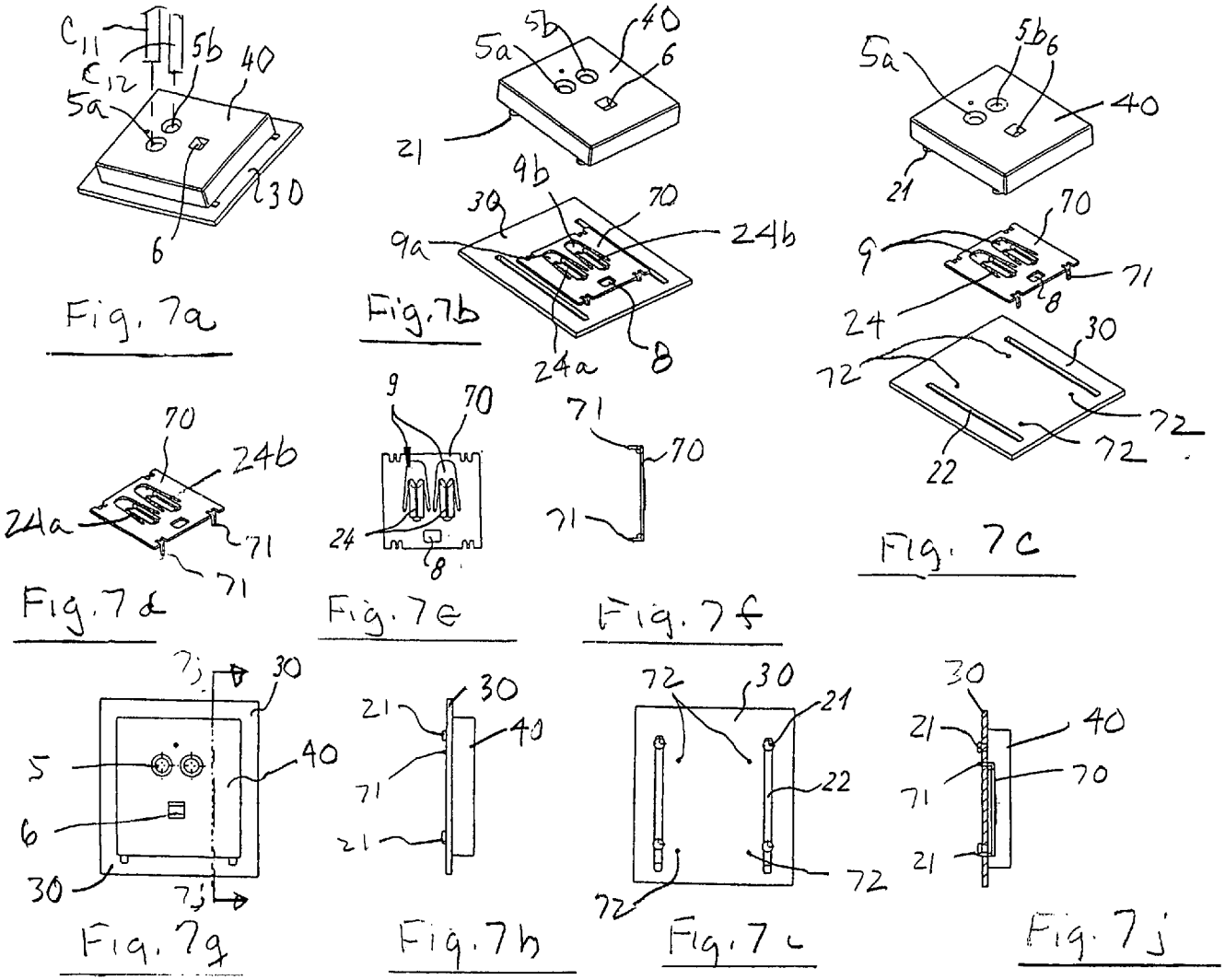
FIG. 7*a* is a front perspective view of a second embodiment of the invention.
FIG. 7*b* is a corresponding perspective view with the cover removed.
FIG. 7*c* is an exploded view of the device of FIG. 7*a*, FIGS. 7*d*–7*f* are perspective, front elevated and side views, respectively, of the operating member of FIG. 7*c*, FIGS. 7*g*–7*i* are front elevation, side, and rear views, respectively, of the device of FIG. 7*a*.
FIG. 7*j* is a sectional view taken along the line 7*j*—7*j* of FIG. 7*g*.

According to a second embodiment of the invention illustrated in FIGS. 7*a*–7*j*, instead of having the operating member move within the chamber of a rigid housing, the operating member 70 is fixed to the base member 30, and the insulation piercing operation is effected by displacing the cover member 40 relative to the base member 30. More particularly, the cover member 40 is provided on its lower edge portion with slide projections 21 that extend within parallel glide slots 22 contained in the base member 30, as best shown in FIG. 7*c*. The conductive operating member 70 is supported in parallel spaced relation relative to the non-conductive synthetic plastic base member 30 by means of integral support legs 71 that extend within corresponding openings 72 contained in the base plate. In this embodiment, in order to connect a pair of insulated conductors $C_{11}$ and $C_{12}$ inserted into the first conductor openings in cover member 40, the tip of the operating tool (i.e., the screwdriver, not shown) is inserted into the housing chamber via the tool access opening 6 for engagement at its tip with the recess 8 on the fixed stationary operating member 3. Upon pivotal movement of the operating tool, the cover member 40, together with the conductors $C_{11}$ and $C_{12}$ carried thereby, are displaced relative to the base member 30 and the operating member fixed thereto, whereby the insulation layers are pierced by the piercing means 24*a* and 24*b*, thereby to electrically connect the conductors via the stationary conductive operating plate 70.

Figure 8B:
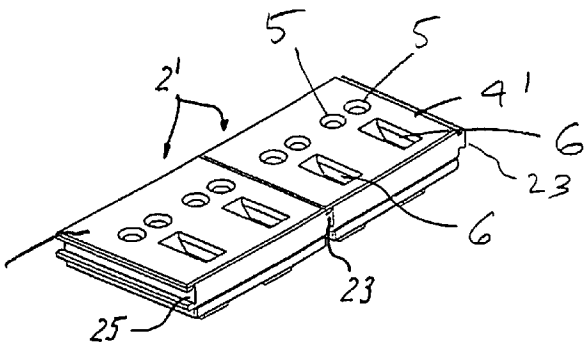
FIG. 8*b* is a perspective view of the completed assembly of FIG. 8*a*, FIGS. 8*c* and 8*d* are rear and front elevation views, respectively, illustrating the mounting of a junction block assembly of FIG. 8*a* on a fixed support.
Figure 8A:
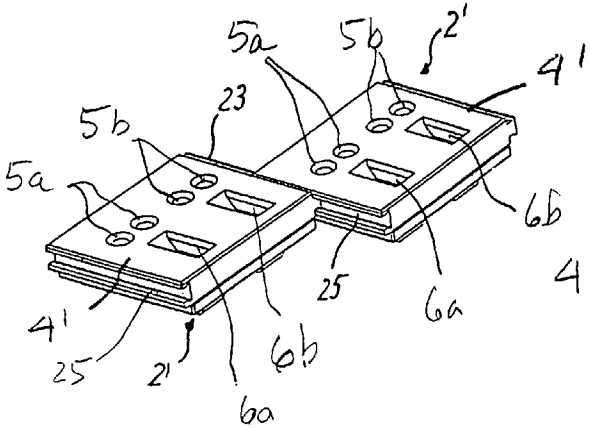
FIG. 8*a* is a perspective view illustrating the a manner of joining a pair of the junction block connector devices of FIG. 3*a* to form an assembly.
Figure 8D:
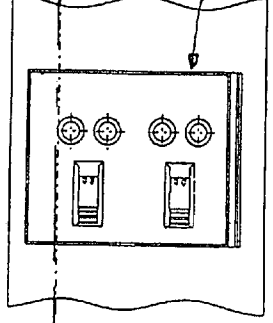
FIG. 8*e* is a sectional view taken along line 8*e*—8*e* of FIG. 8*d*.
Figure 8C:
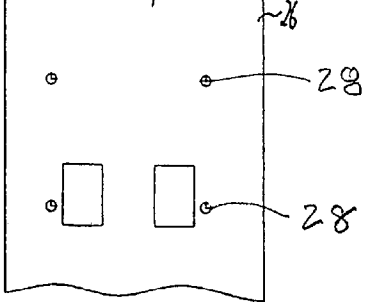
Figure 8E:
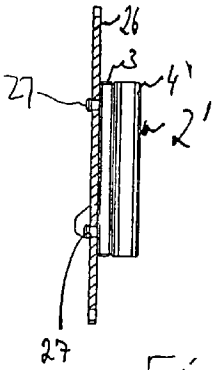

According to another feature of the invention, it is possible to connect a plurality of the relatively thin flat junction blocks in side-to-side relation, thereby to achieve the desired connections when only limited space is available. Referring to FIGS. 8*a*–8*e*, the opposite ends of the rectangular housings 4' of FIG. 3*a* are provided with cooperating male and female slide elements 23 and 25, respectively. The connectors may be of the leaf spring and slot type, the tongue and groove type, or any other suitable type of slide connection. Thus, when only limited space is available, a first junction block assembly 2' may be fastened to a fixed support 26 by means of integral pins 27 on the housing that extend into corresponding openings 28 contained in the fixed support 26. Then, as shown in FIGS. 8*a* and 8*b*, a second junction block assembly may be slidably fastened in supported relation to the first junction block assembly.

The various embodiments and modifications of the invention afford the advantage that the junction block devices are relatively flat and thin, having a height of only a few millimeters, the height being preferably about 0.3 times the width and/or length dimensions. The invention offers the advantage that various types and sizes of conductors may be connected by various combinations of insulation piercing and soldering techniques.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A connector junction block assembly adapted for connection with a plurality of insulated electrical conductors, comprising:

(a) a generally planar base member (3);

(b) a cover member (4) connected with said base member to define a rigid housing (2) containing a chamber, said base and cover members being formed from an electrically insulating synthetic plastic material; and (c) at least one electrically conductive operating member (7) arranged in said chamber for sliding displacement in a direction generally parallel with said base member between first and second positions relative to said cover and base members;

(d) said cover member containing at lease one first conductor opening (5) adapted to receive one end of the insulated conductor that is introduced into said chamber when said operating member is in said first position;

(e) said operating member containing a second conductor opening (9) that is arranged opposite said first conductor opening when said operating member is in said first position, thereby to receive the insulated conductor end that is introduced into said chamber, said second conductor opening including insulation piercing means (24) having at least one cutting edge (11;12) operable to pierce the conductor insulation and to electrically engage the conductor when said operating member is displaced from said first position to said second position.

2. A connector junction block assembly as defined in claim 1, wherein said operating member comprises a planar metal plate.

3. A connector junction block assembly as defined in claim 1, wherein said insulation piercing means includes a pair of cutting edges (11; 12) arranged to pierce the insulation at diametrically opposite portions of the conductor.

4. A connector junction block as defined in claim 1, wherein said housing has a generally rectangular configuration; and further wherein said housing has a thickness that is small relative to its width and length dimensions.

5. A connector junction block assembly as defined in claim 1, and further including means (23, 25) for connecting together a pair of said housings in side-by-side relation.

6. A connector junction block assembly as defined in claim 5, and further including fastener means (27) for fastening one of said housings to a fixed support.

7. A connector junction block assembly as defined in claim 1, wherein said base member contains a recess (13, 14) in which said operating member is slidably mounted for displacement between said first and second positions.

8. A connector junction block assembly as defined in claim 7, wherein the depth of the base member recess is greater than the thickness of the operating member.

9. A connector junction block assembly as defined in claim 8, wherein said base member includes bridge portions (15) extending into said recesses for supporting said operating member in spaced relation above the bottom wall of said recess.

10. A connector junction block assembly as defined in claim 9, wherein said base member contains a third conductor opening (16) opposite said first conductor opening, said third conductor opening being arranged to receive and support the free extremity of the end of a conductor that is inserted into said housing chamber via said first and second conductor openings.

11. A connector junction block assembly as defined in claim 1, and further including means including a tool access opening (6) contained in said cover member, and a corresponding operating recess (8) contained in said operating member, said operating recess being arranged to receive the tip of a tool (17) for displacing said operating member between said first and second positions.

12. A connector junction block as defined in claim 11, wherein a pair of said first conductor openings (5) are arranged on opposite sides of said tool access opening (6); and further wherein a pair of said second conductor openings (9) are contained in said operating member on opposite sides of said operating recess (8).

13. A connector junction block assembly as defined in claim 11, wherein at least two of said operating members are arranged for parallel sliding movement within said housing chamber, each of said operating members containing, when in said first position, a second conductor opening opposite a corresponding first conductor opening contained in said cover member.

14. A connector junction block assembly as defined in claim 13, wherein each of said operating members contains at least two of said second conductor openings arranged opposite corresponding first conductor openings contained in said cover member.

15. A connector junction block assembly adapted for connection with a plurality of insulated electrical conductors, comprising:

(a) a generally planar base member (3);

(b) a cover member (4) cooperating with said base member to define a housing (2) containing a chamber, said base and cover members being formed from an electrically insulating synthetic plastic material; and (c) at least one electrically conductive operating member (7) arranged in said chamber for displacement in a direction generally parallel with said base member between first and second positions relative to at least one of said cover and base members, said operating member including an orthogonally arranged soldering tab portion (20) that extends outwardly from said chamber via a corresponding tab opening (19) contained in said cover member;

(d) said cover member containing at lease one first conductor opening (5) adapted to receive one end of the insulated conductor that is introduced into said chamber when said operating member is in said first position;

(e) said operating member containing a second conductor opening (9) that is arranged opposite said first conductor opening when said operating member is in said first position, thereby to receive the insulated conductor end that is introduced into said chamber, said second conductor opening including insulation piercing means (24) having at least one cutting edge (11;12) operable to pierce the conductor insulation and to electrically engage the conductor when said operating member is displaced from said first position to said second position.

16. A connector junction block assembly as defined in claim 15, and further including means for connecting together the edge portions of a pair of said housings in side-by-side relation.

17. A connector junction block assembly adapted for connection with a plurality of insulated electrical conductors, comprising:

(a) a generally planar base member (3);

(b) a cover member (4) slidably connected with said base member for displacement between first and second positions relative to said base member, said cover member cooperating with said base member to define a housing (2) containing a chamber, said base and cover members being formed from an electrically insulating synthetic plastic material; and (c) at least one electrically conductive operating member (7) mounted in said chamber in parallel spaced relation to said base member;

(d) said cover member containing at lease one first conductor opening (5) adapted to receive one end of the insulated conductor that is introduced into said chamber when said cover member is in said first position;

(e) said operating member containing a second conductor opening (9) that is arranged opposite said first conductor opening when said operating member is in said first position, thereby to receive the insulated conductor end that is introduced into said chamber, said second conductor opening including insulation piercing means (24) having at least one cutting edge (11;12) operable to pierce the conductor insulation and to electrically engage the conductor when said cover member is displaced from said first position to said second position.

18. A connector junction block assembly as defined in claim 17, and further including means for connecting together the edge portions of a pair of said housings in side-by-side relation.

* * * * *